US009062945B2

(12) United States Patent
Bruns

(10) Patent No.: US 9,062,945 B2
(45) Date of Patent: Jun. 23, 2015

(54) NUTATING SPLIT PETAL FLARE FOR PROJECTILE FLUID DYNAMIC CONTROL

(75) Inventor: Jon Bruns, Florissant, MO (US)

(73) Assignee: THE BOEING COMPANY, Chicago, IL (US)

( * ) Notice: Subject to any disclaimer, the term of this patent is extended or adjusted under 35 U.S.C. 154(b) by 785 days.

(21) Appl. No.: 13/205,636

(22) Filed: Aug. 9, 2011

(65) Prior Publication Data

US 2013/0037651 A1 Feb. 14, 2013

(51) Int. Cl.

| | |
|---|---|
| ***F42B 10/18*** | (2006.01) |
| ***F42B 10/14*** | (2006.01) |
| ***F42B 10/50*** | (2006.01) |

(52) U.S. Cl.

CPC ..... *F42B 10/14* (2013.01); *F42B 10/50* (2013.01)

(58) Field of Classification Search

USPC ..... 244/3.3, 3.21, 3.28

See application file for complete search history.

(56) References Cited

U.S. PATENT DOCUMENTS

| | | | | |
|---|---|---|---|---|
| 6,723,972 | B2 * | 4/2004 | Schroeder et al. | 244/3.3 |
| 6,745,978 | B1 | 6/2004 | King et al. | |
| 6,869,043 | B1 | 3/2005 | Carlyle et al. | |
| 7,004,424 | B1 | 2/2006 | Pacchia | |
| 2002/0079404 | A1 | 6/2002 | Schroeder et al. | |

FOREIGN PATENT DOCUMENTS

WO 2009/113048 A1 9/2009

OTHER PUBLICATIONS

Extended European Search Report, EP 12179725, Nov. 29, 2011.

* cited by examiner

*Primary Examiner* — Brian M O'Hara

(74) *Attorney, Agent, or Firm* — Ameh IP; Elahe Toosi; Lowell Campbell

(57) ABSTRACT

A system and methods for fluid dynamically controlling a projectile are disclosed. At least one actuator coupled to at least one common actuation structure is actuated to provide an actuation force via the common actuation structure. The actuation force is transferred through at least one linkage structure to at least one fluid dynamic control surface coupled thereto.

20 Claims, 5 Drawing Sheets

NUTATING SPLIT PETAL FLARE FOR PROJECTILE FLUID DYNAMIC CONTROL

FIELD

Embodiments of the present disclosure relate generally to fluid dynamic control. More particularly, embodiments of the present disclosure relate to projectile fluid dynamic control.

BACKGROUND

A projectile is a powered or unpowered fluid dynamic object operable for travel through a space. The space may be, for example, the Earth's atmosphere, outer space, water, an enclosed space, and the like. A projectile may be unpowered with initial power for flight provided by a motive force such as: gas expansion, kinetic energy, chemical reactions, electromagnetic rail guns, coil guns, mass drivers, pneumatic rifles, gravity, firearms, guns, howitzers, blowguns, and the like. A projectile may be powered. For example, some projectiles may provide propulsion during flight by means of a rocket engine or jet engine. Existing projectiles utilize control mechanisms with associated high weight and high volume that may not provide optimal control thereof.

SUMMARY

A system and methods for fluid dynamically controlling a projectile are disclosed. At least one actuator coupled to at least one common actuation structure is actuated to provide an actuation force via the common actuation structure. The common actuation structure is coupled to at least one linkage structure that transfers the actuation force therethrough to at least one fluid dynamic control surface. The fluid dynamic control surface is then extended into or retracted from an airstream in response to the transferred actuation force. In this manner, a number of actuators driving a split petal flare assembly can be significantly reduced providing a low complexity, low weight method of optimally controlling the projectile.

In an embodiment, a projectile body fluid dynamic control system comprises at least one fluid dynamic control surface, at least one linkage structure, at least one common actuation structure, and at least one actuator. The fluid dynamic control surface is coupled to a fluid dynamic body and is operable to extend into a fluid stream around the fluid dynamic body. The linkage structure is coupled to the fluid dynamic control surface and is operable to extend the fluid dynamic control surface into the fluid stream. The common actuation structure is coupled to the linkage structure and is operable to transfer an actuation force through the linkage structure such that the fluid dynamic surface is extended in to the fluid stream. The actuator is coupled to the common actuation structure and is operable to provide the actuation force.

In another embodiment, a method for fluid dynamically controlling a projectile comprises actuating at least one actuator coupled to at least one common actuation structure, and providing an actuation force via the common actuation structure. The method further transfers the actuation force through at least one linkage structure to at least one fluid dynamic control surface coupled thereto.

In yet another embodiment, a method of providing a projectile body fluid dynamic control system comprises providing a plurality of nutating petal flares each comprising a respective linkage structure of a plurality of linkage structures. The method further couples the nutating petal flares to an aft end of a projectile body, couples a common actuation structure to the linkage structures, and couples the common actuation structure to at least one actuator.

This summary is provided to introduce a selection of concepts in a simplified form that are further described below in the detailed description. This summary is not intended to identify key features or essential features of the claimed subject matter, nor is it intended to be used as an aid in determining the scope of the claimed subject matter.

BRIEF DESCRIPTION OF DRAWINGS

A more complete understanding of embodiments of the present disclosure may be derived by referring to the detailed description and claims when considered in conjunction with the following figures, wherein like reference numbers refer to similar elements throughout the figures. The figures are provided to facilitate understanding of the disclosure without limiting the breadth, scope, scale, or applicability of the disclosure. The drawings are not necessarily made to scale.

DETAILED DESCRIPTION

Figure 1:
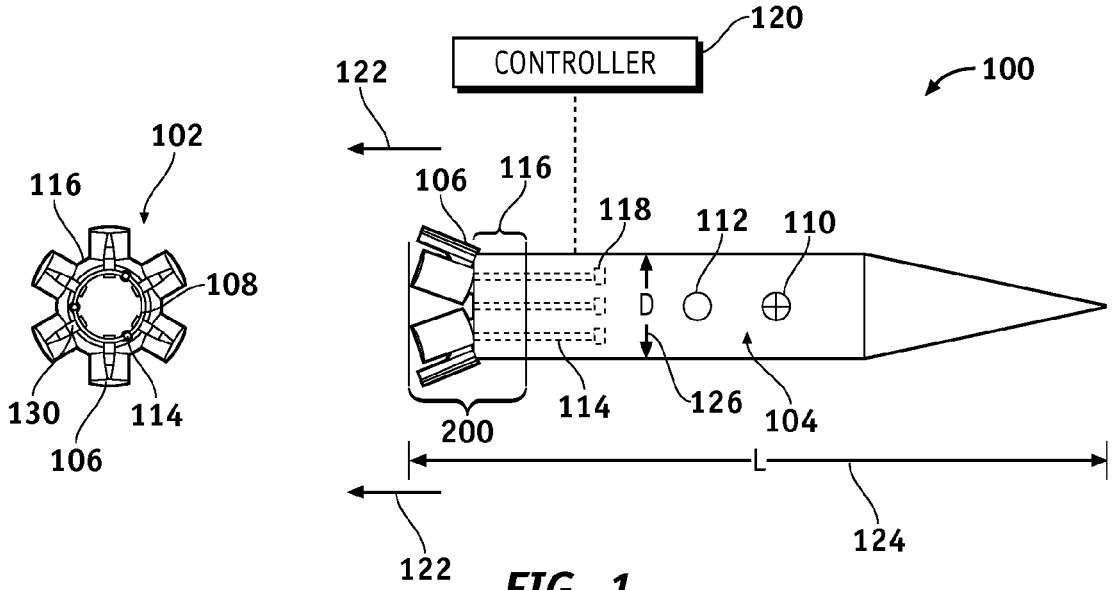
FIG. 1 is an illustration of a side view of an exemplary projectile comprising a projectile flight body aerodynamic control system according to an embodiment of the disclosure.

The following detailed description is exemplary in nature and is not intended to limit the disclosure or the application and uses of the embodiments of the disclosure. Descriptions of specific devices, techniques, and applications are provided only as examples. Modifications to the examples described herein will be readily apparent to those of ordinary skill in the art, and the general principles defined herein may be applied to other examples and applications without departing from the spirit and scope of the disclosure. Furthermore, there is no intention to be bound by any expressed or implied theory presented in the preceding field, background, summary or the following detailed description. The present disclosure should be accorded scope consistent with the claims, and not limited to the examples described and shown herein.

Embodiments of the disclosure may be described herein in terms of functional and/or logical block components and various processing steps. It should be appreciated that such block components may be realized by any number of hardware, software, and/or firmware components configured to perform the specified functions. For the sake of brevity, conventional techniques and components related to aerodynamics, fluid dynamics, structures, control surfaces, manufacturing, and other functional aspects of the systems (and the individual operating components of the systems) may not be described in detail herein. In addition, those skilled in the art will appreciate that embodiments of the present disclosure may be practiced in conjunction with a variety of structural bodies, and that the embodiments described herein are merely example embodiments of the disclosure.

Embodiments of the disclosure are described herein in the context of a practical non-limiting application, namely, an electromagnetic rail gun projectile. Embodiments of the disclosure, however, are not limited to such electromagnetic rail gun applications, and the techniques described herein may also be utilized in other fluid dynamic applications. For example, embodiments may be applicable to bullets, missiles, torpedoes, rockets, reentry vehicles, and the like.

As would be apparent to one of ordinary skill in the art after reading this description, the following are examples and embodiments of the disclosure and are not limited to operating in accordance with these examples. Other embodiments may be utilized and structural changes may be made without departing from the scope of the exemplary embodiments of the present disclosure.

Existing projectiles utilize a separate control mechanism for each flap increasing a number of motors and drive electronics and their associated weight and volume. Additionally, existing solutions utilize flaps embedded in a projectile tail increasing weight and volume. Using a tail control example, the control surface flaps are typically embedded in a fixed geometry tail flare structure. In contrast, a split petal flare described herein uses the entire tail volume for control surface. Also for existing solutions, a fixed geometry of the projectile tail sets static margin. This static margin varies with flight conditions and is not optimal over all flight conditions. So a fixed diameter flare, while optimal for one condition, is not generally optimal over an entire flight regime. The split petal flare described herein allows changing the flare diameter to match flight conditions over the entire flight regime.

According to embodiments of the disclosure, a nutating split petal flare for projectile aerodynamic control and/or fluid dynamic control comprises a petal flare control surface assembly installed on an aft end of a flight body. A number of petals may be three or greater. The petals are mechanically inter-connected by a common actuation structure so that the entire split petal flare assembly can be driven by only three actuators for example, providing tail nutation for flight body maneuver actuated ring and flare diameter control for a variable flight body static margin. The variable flight static margin is a static margin that can change during a trajectory of a projectile to minimize drag, improve maneuverability and increase range. For a given flare diameter, the static margin changes with flight conditions causing differences in drag and stability that affect projectile performance. By varying a flare diameter, the static margin can be adjusted to produce a desired static margin over a flight regime.

FIG. 1 is an illustration of a side view of an exemplary projectile 100 comprising a projectile flight body aerodynamic control system 200 (system 200) according to an embodiment of the disclosure. The projectile 100 may comprise an aerodynamic body 104 and the system 200.

The aerodynamic body 104 may comprise, for example but without limitation, an electromagnetic rail gun projectile, a bullet, a missile, a torpedo, a rocket, a reentry vehicle, and the like. In some embodiments, the projectile 100 has a length L 124, ranging from about 30 cm to about 90 cm, and a cross-sectional diameter, D 126, of about 4 cm to about 7 cm. In the embodiment shown in FIG. 1 the aerodynamic body 104 has a constant diameter D throughout its length. In other embodiments, the aerodynamic body 104 may have a different configuration, such as, for example but without limitation, a conic, a power-law fore-body, a boat-tail aft-body, and the like. In some embodiments, the projectile 100 has a mass ranging from about 1.5 kg to about 12.5 kg, and can reach targets at a range of about 400 km while launched at a velocity of about Mach 7 or more.

The system 200 may comprise a control surface assembly 102 and its associated linkage structure 130, at least one common actuation structure 108, at least one actuator 118 (actuators 118), and a controller 120.

The control surface assembly 102 comprises at least one aerodynamic control surface 106 comprising at least one linkage structure 130. The control surface assembly 102 and the aerodynamic control surface 106 are installed and located on an aft end 116 of the aerodynamic body 104. The aerodynamic control surface 106 may comprise at least one petal (petal 106). In one embodiment, three or greater number of petals 106 may be used. The aerodynamic control surface 106 is coupled to the aerodynamic body 104, and is operable to extend into an airstream 122 or retract form the airstream 122 around the aerodynamic body 104. In this document, aerodynamic control surface 106, petals 106, and nutating split petal flares 106 may be used interchangeably.

The linkage structure 130 is coupled to the aerodynamic control surface 106 and is operable to extend the aerodynamic control surface 106 into the airstream 122 or retract the aerodynamic control surface 106 away from the airstream 122 as explained in more detail below. The linkage structure 130 may comprise, for example but without limitation, a ramp (e.g., 204 in FIG. 2), a push-pull rod, and the like.

The common actuation structure 108 may comprise, for example but without limitation, a common actuation ring 108 as shown in FIG. 1, a common actuation disk, a common actuation annulus, a common actuation polygonal solid, and the like. The common actuation structure 108 is coupled to the linkage structure 130, and is operable to transfer an actuation force through the linkage structure 130. The common actuation structure 108 may be coupled to the actuator 118 by one or more connecting push-pull rods 114.

The actuator 118 is coupled to the common actuation structure 108 and is operable to provide the actuation force. The actuator 118 may be controlled by the controller 120 to operate the control surface assembly 102 to control the aerodynamic body 104. The petals 106 are mechanically interconnected via the common actuation structure 108 so that the entire system 200 can be driven by only three actuators 118 via connecting push-pull rods 114.

The controller 120 is configured to control the actuator 118 to operate the control surface assembly 102. The controller 120 is also configured to control actuation of the petals 106 to vary the static margin as needed. The petals 106 provide nutation of the aft end 116 for the aerodynamic body 104 when the common actuation ring 108 is maneuver actuated in response to the actuation of the actuator 118 by the controller 118. Thereby the petals 106 provide flare diameter control to provide control of variable body static margin. In this manner, the controller 120 dynamically adjusts static margin of the aerodynamic body 104 based on and as a function of flight conditions and desired maneuverability.

In missile analysis, static margin is defined as a distance between a center of gravity (CG) 110 and a center of pressure (CP) 112. If the CG 110 is forward of the CP 112 (shown in FIG. 1) then the projectile 100 will respond to a disturbance by producing an aerodynamic moment that returns the projectile 100 to an angle that existed prior to the disturbance. Such a condition is one of positive static stability and the static margin is positive. If the CG 110 is behind the CP 112, then any disturbance will produce a moment that continues to drive the projectile 100 away from the starting position. Such a condition is one of negative static stability and the static margin is negative. The controller 120 and a manner in which the static margin is controlled are discussed in additional detail in the context of discussion of FIG. 6.

Figure 2:
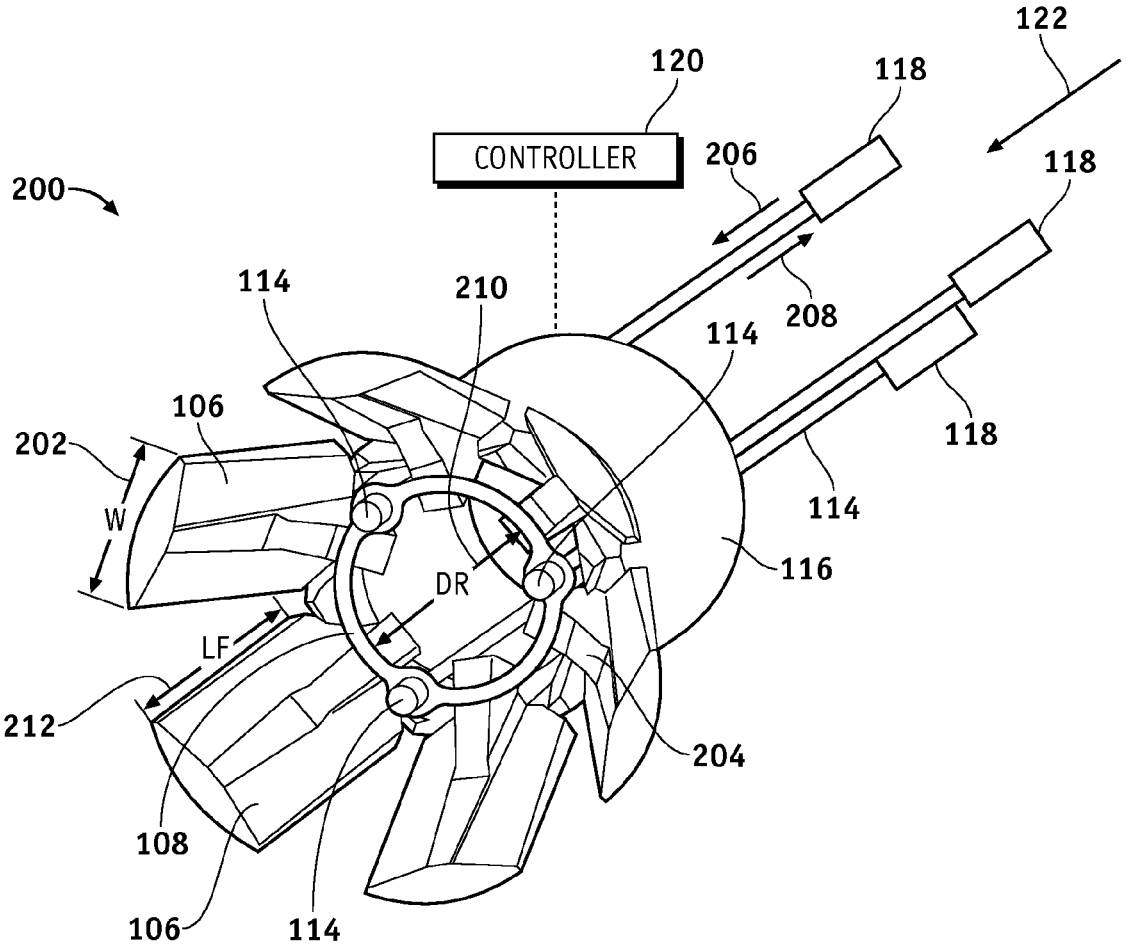
FIG. 2 is an illustration of a perspective view of an exemplary projectile flight body aerodynamic control system according to an embodiment of the disclosure.

FIG. 2 is an illustration of a perspective expanded view of the projectile flight body aerodynamic control system 200 (system 200) shown in FIG. 1 according to an embodiment of the disclosure. The system 200 may comprise a plurality of the petals 106, the common actuation ring 108, a plurality of the push-pull rods 114, the aft end 116, the controller 120, and a plurality of the actuators 118.

The petals 106 (nutating split petal flares 106), are linked to one another via the common actuation ring 108 and are configured to move in nutating motion at the aft end 116 of the aerodynamic body 104. The nutating motion may be a precession substantially about an axis similar to, for example but without limitation, motions of a coin wobbling on a table, a tire wobbling on a ground after being dropped with the flat side down, a change in direction of a rotation axis in which an Euler angle is constant, and the like. Nutating motion of the petals 106 provides control of, for example but without limitation, a direction, a rotation, and the like, of the aerodynamic body 104. Nutation allows compensation for a rolling motion of the projectile 100. For example, if upper petals are extended to affect a maneuver upwards, as the projectile 100 rotates, extended petals can be retracted and the petals rotating into the upper position extended, thus maintaining the maneuver.

The petals 106 are configured to extend and retract via the common actuation ring 108 in a coordinated manner. As mentioned above, the petals 106 are configured to provide nutation of the aft end 116 for the aerodynamic body 104 when the common actuation ring 108 is maneuver actuated in response to the actuation of the actuator 118 by the controller 118. In this manner, the petals 106 provide flare diameter control to provide control of variable body static margin.

Each of the petals 106 comprise the linkage structure 204 (130 in FIG. 1) allowing the common actuation ring 108 to extend the petals 106 into the airstream 122 outwardly in response to a pull actuation force 208. The petals 106 are retracted inwardly away from the airstream 122 in response to a push actuation force 206. The length LF 212 of the petals 106 may range from, for example but without limitation, about 2 cm to about 8 cm, and the like. The width W 202 of each of the petals 106 may range from, for example but without limitation, about 2 cm to about 7 cm, and the like. A number of the petals 106 may be, for example but without limitation, three or more, and the like.

The common actuation ring 108 mechanically interconnects and links the petals 106. The common actuation ring 108 is coupled to the linkage structure 204, and transfers an actuation force through the linkage structure 204. In operation, the common actuation ring 108 transfers the pull actuation force 208 through the linkage structure 204 to at least one of the petals 106 such that at least one of the petals 106 is extended outwardly into the airstream 122. Similarly, the common actuation ring 108 transfers the push actuation force 206 through the linkage structure 204 to at least one of the petals 106 such that at least one of the petals 106 is retracted inwardly away from the airstream 122.

In this manner, only three actuators 118 are required to drive the system 200 versus one actuator per each of the petals 106, thereby reducing weight. The common actuation ring 108 may be coupled to at least one actuator 118 by one or more connecting push-pull rods 114. In the embodiment shown in FIGS. 1-2, a ring is used as the common actuation structure 108 to provide the common actuation ring 108. However, as mentioned above, other actuation structures may in addition or alternatively be used.

In operation, the petals 106 can be extended or retraced using a variety of suitable actuation mechanisms. For example, in some embodiments, a motion of each petal 106 is controlled via actuation of the common actuation ring 108 through the push-pull rod 114 coupled to the actuator 118 located inside the projectile 100. A variety of other suitable actuation mechanisms for the common actuation ring 108 may in addition or alternatively be used. Diameter DR 210 of the common actuation ring 108 may range from, for example but without limitation, about 2 cm to about 5 cm, and the like.

The entire aft end 116 of the system 200 is used as a control surface. This reduces required petal length LF 212 and weight. As mentioned above, only three actuators 118 are required to drive the system 200 versus one actuator per petal 106, which also reduces weight. Use of the system 200 with interconnected petals 106 allows control via use of the aft end 116 in a high-dynamic-pressure hypervelocity environment. The actuators 118 may be sized to fit within the available power, weight, and volume constraints of the projectile 100 for a physical environment. In this manner, reduced tail weight improves static margin of the projectile 100.

Diameter DT 302 (FIG. 3) of the aft end 116 may range from, for example but without limitation, about 3 cm to about 6 cm, and the like. When fully closed (FIG. 4), the system 200 provides substantially minimum diameter, base drag, and stability. When fully opened (FIGS. 2 and 5), the system 200 provides substantially maximum stability for rapid projectile attitude correction during atmospheric re-entry. The system 200 allows common mode petal commands to adjust static margin in flight. In this manner, aero performance benefits provide improved range performance.

A set of three actuators 118 forms a drive mechanism for maneuvering the common actuation ring 108 as an actuating structure in contact with the petals 106. For example, as mentioned above, the common actuation ring 108 extends at least one of the petals 106 (petal 106) outwardly into the airstream 122 by transferring the pull actuation force 208 through the linkage structure 204 of the petal 106. Also, the common actuation ring 108 retracts the petal 106 inwardly away from the airstream 122 by transferring the push actuation force 206 through the linkage structure 204 of the petal 106.

Figure 3:
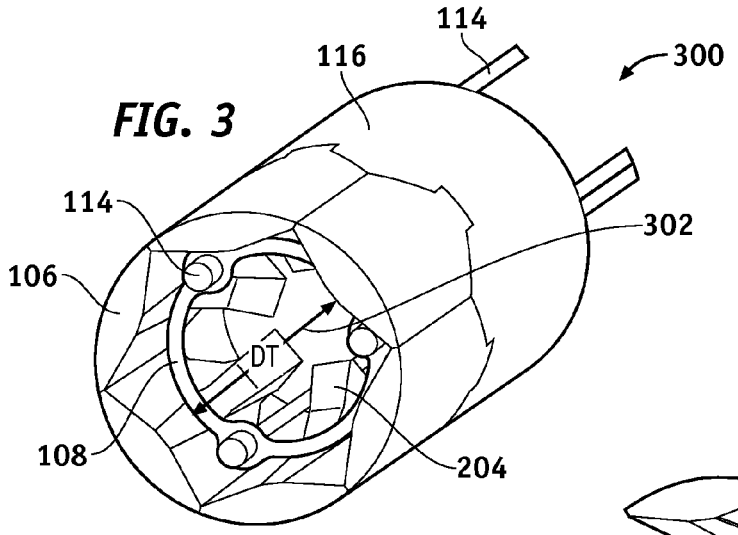
FIG. 3 is an illustration of a perspective view of the projectile flight body aerodynamic control system of FIG. 2 in a fully closed low drag position according to an embodiment of the disclosure.

FIG. 3 is an illustration of a perspective view of the projectile flight body aerodynamic control system 200 in a low drag fully closed position 300 according to an embodiment of the disclosure. In the low drag fully closed position 300, the system 200 generates substantially minimum drag and stability.

Figure 4:
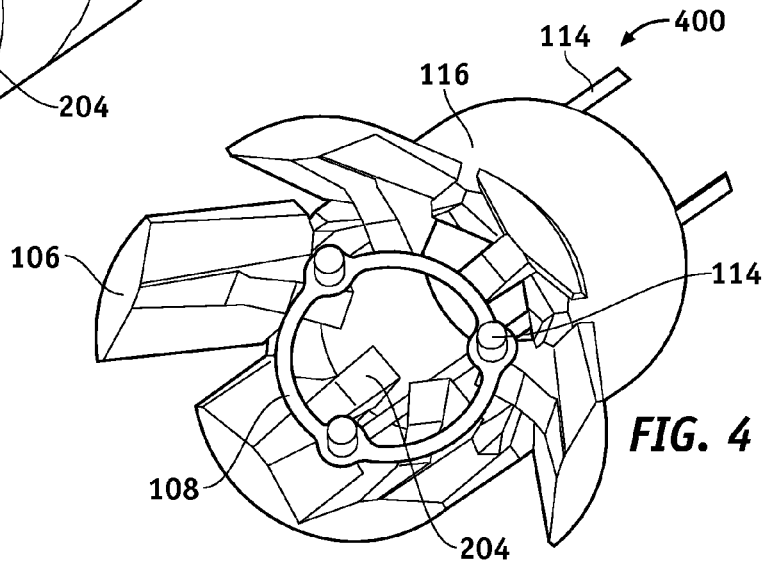
FIG. 4 is an illustration of a perspective view of the projectile flight body aerodynamic control system of FIG. 2 in a maneuver actuated ring configuration according to an embodiment of the disclosure.

FIG. 4 is an illustration of a perspective view of the projectile flight body aerodynamic control system 200 in a maneuver actuated ring configuration 400 according to an embodiment of the disclosure. In this configuration the projectile 100 can perform G-Maneuver by differentially commanding the petals 106 via the controller 120.

Figure 5:
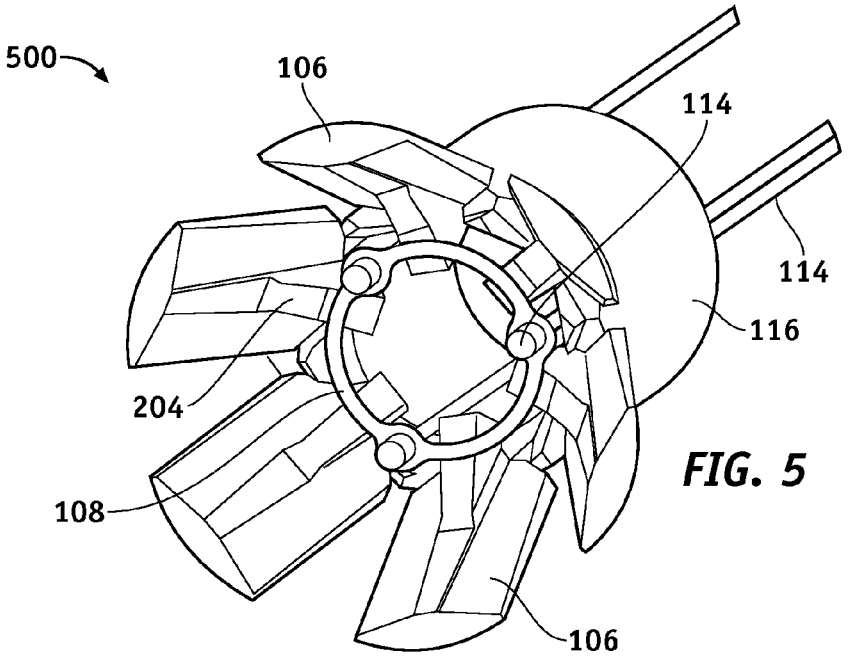
FIG. 5 is an illustration of a perspective view of the projectile flight body aerodynamic control system of FIG. 2 in a higher drag non-maneuver actuated ring configuration according to an embodiment of the disclosure.

FIG. 5 is an illustration of a perspective view of the projectile flight body aerodynamic control system 200 in a fully deployed and higher drag non-maneuver actuated ring configuration 500 according to an embodiment of the disclosure. In this configuration the projectile 100 can use common command to adjust the static margin and maneuverability over flight regime and for maneuvers. Full deployment provides rapid rate capture on re-entry.

Figure 6:
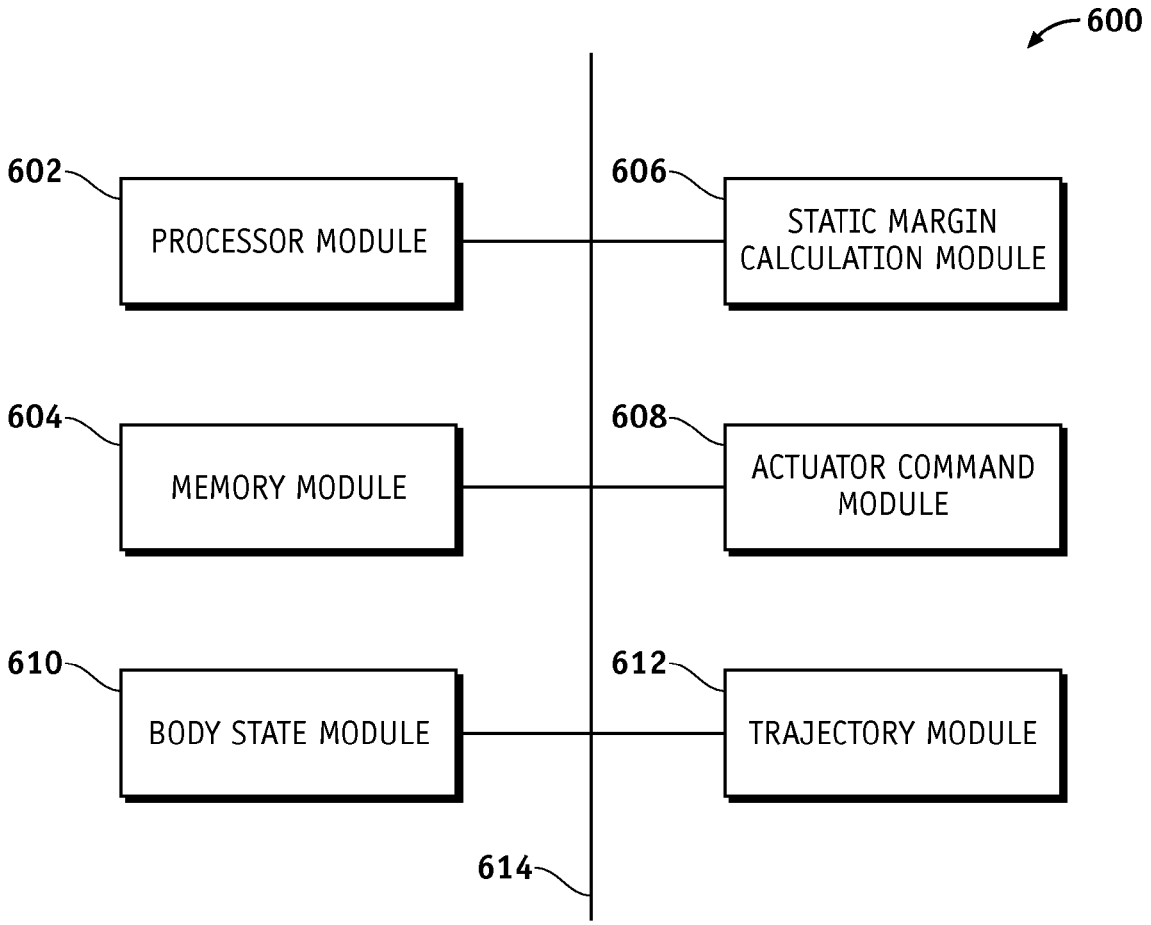
FIG. 6 is an illustration of an exemplary functional block diagram of a controller of a projectile flight body aerodynamic control system according to an embodiment of the disclosure.

FIG. 6 is an illustration of an exemplary functional block diagram of the controller 120 (system 600) of the projectile flight body aerodynamic control system 200 according to an embodiment of the disclosure. The system 600 may comprise a processor module 602, a memory module 604, a static margin calculation module 606, an actuator command module 608, a body state module 610, and a trajectory module 612. These modules may be communicatively coupled to each other via a bus 614.

The processor module 602 comprises processing logic that is configured to carry out the functions, techniques, and processing tasks associated with the operation of the system 600. In particular, the processing logic is configured to support the system 600 described herein. For example, the processor module 602 may direct the actuator command module 608 to command actuation of the common actuation structure 108 via the actuators 118.

For another example, the processor module 602 may adjust the static margin of the aerodynamic body 104 as a function of flight conditions and desired maneuverability. In this manner, the processor module 602 receives flight configuration data from a flight control computer (not shown), and directs the static margin calculation module 606 to calculate the static margin based on the received flight configuration data. The processor module 602 may then direct the actuator command module 608 to command the actuators 118 to actuate the common actuation structure 108 to adjust the static margin via actuation of the petals 106. The petals 106 may then provide nutation of the aft end 116 for the aerodynamic body 104 when the common actuation structure 108 is maneuver actuated in response to the actuation of the actuator 118. Thereby, the petals 106 provide flare diameter control to provide control of the variable body static margin.

The processor module 602 may be implemented, or realized, with a general purpose processor, a content addressable memory, a digital signal processor, an application specific integrated circuit, a field programmable gate array, any suitable programmable logic device, discrete gate or transistor logic, discrete hardware components, or any combination thereof, designed to perform the functions described herein. In this manner, a processor may be realized as a microprocessor, a controller, a microcontroller, a state machine, or the like. A processor may also be implemented as a combination of computing devices, e.g., a combination of a digital signal processor and a microprocessor, a plurality of microprocessors, one or more microprocessors in conjunction with a digital signal processor core, or any other such configuration.

The memory module 604 may comprise a data storage area with memory formatted to support the operation of the system 600. The memory module 604 is configured to store, maintain, and provide data as needed to support the functionality of the system 600. For example, the memory module 604 may store flight configuration data, static margin data, flare diameter data, and the like.

In practical embodiments, the memory module 604 may comprise, for example but without limitation, a non-volatile storage device (non-volatile semiconductor memory, hard disk device, optical disk device, and the like), a random access storage device (for example, SRAM, DRAM), or any other form of storage medium known in the art.

The memory module 604 may be coupled to the processor module 602 and configured to store, for example but without limitation, a database, and the like. Additionally, the memory module 604 may represent a dynamically updating database containing a table for updating the database, and the like. The memory module 604 may also store, a computer program that is executed by the processor module 602, an operating system, an application program, tentative data used in executing a program, and the like.

The memory module 604 may be coupled to the processor module 602 such that the processor module 602 can read information from and write information to the memory module 604. For example, the processor module 602 may access the memory module 604 to access the aircraft speed, flight control surface positions, angle of attack, Mach number, altitude, the static margin data, flare diameter data, and the like.

As an example, the processor module 602 and memory module 604 may reside in respective application specific integrated circuits (ASICs). The memory module 604 may also be integrated into the processor module 602. In an embodiment, the memory module 604 may comprise a cache memory for storing temporary variables or other intermediate information during execution of instructions to be executed by the processor module 602.

The static margin calculation module 606 is configured to calculate the static margin at various flight conditions. In some embodiments, when the petals 106 are deflected outwards, the projectile 100 has a statically stable, tri-conic geometry with a static-margin greater than, for example, about 10%. Alternatively, in some embodiments, when the petals 106 are deflected inwards, the projectile 100 may have a near neutral-stable, bi-conic geometry with a static-margin approaching, for example, about 0%. Therefore, the petals 106 can be operated advantageously during both unguided and guided phases of a flight of the projectile 100. The flight may be, for example but without limitation, endoatmospheric, exoatmospheric, aquatic (i.e., in some embodiments, e.g., torpedoes), and the like.

The actuator command module 608 is configured to command actuation of the common actuation structure 108 to adjust the static margin and effect maneuvers. The actuator command module 608 receives input parameters such as an acceleration command, a desired path, and a body state from the body state module 610 and the trajectory module 612, and outputs the actuator 118 position and the corresponding actuation forces such as the push actuation force 206 and the pull actuation force 208. The petals 106 then operate by the common actuation structure 108 via receiving the actuation forces 206/208 through the linkage structure 204. In this manner the system 600 allows common mode petal commands to adjust the static margin in flight as explained above. Thereby, providing aero performance benefits to improve range performance.

The body state module 610 is configured to measure and/or estimate a body state of the projectile 100. The body state may comprise, for example but without limitation, a velocity, a position, an altitude, an angular rate, an acceleration, an acceleration command, a feedback signal such as: body acceleration, a rate, a current actuator position, configuration data, and the like.

The trajectory module 612 is configured to determine maneuvers to obtain a desired path through, for example but without limitation, a space, a fluid, and the like.

Figure 7:
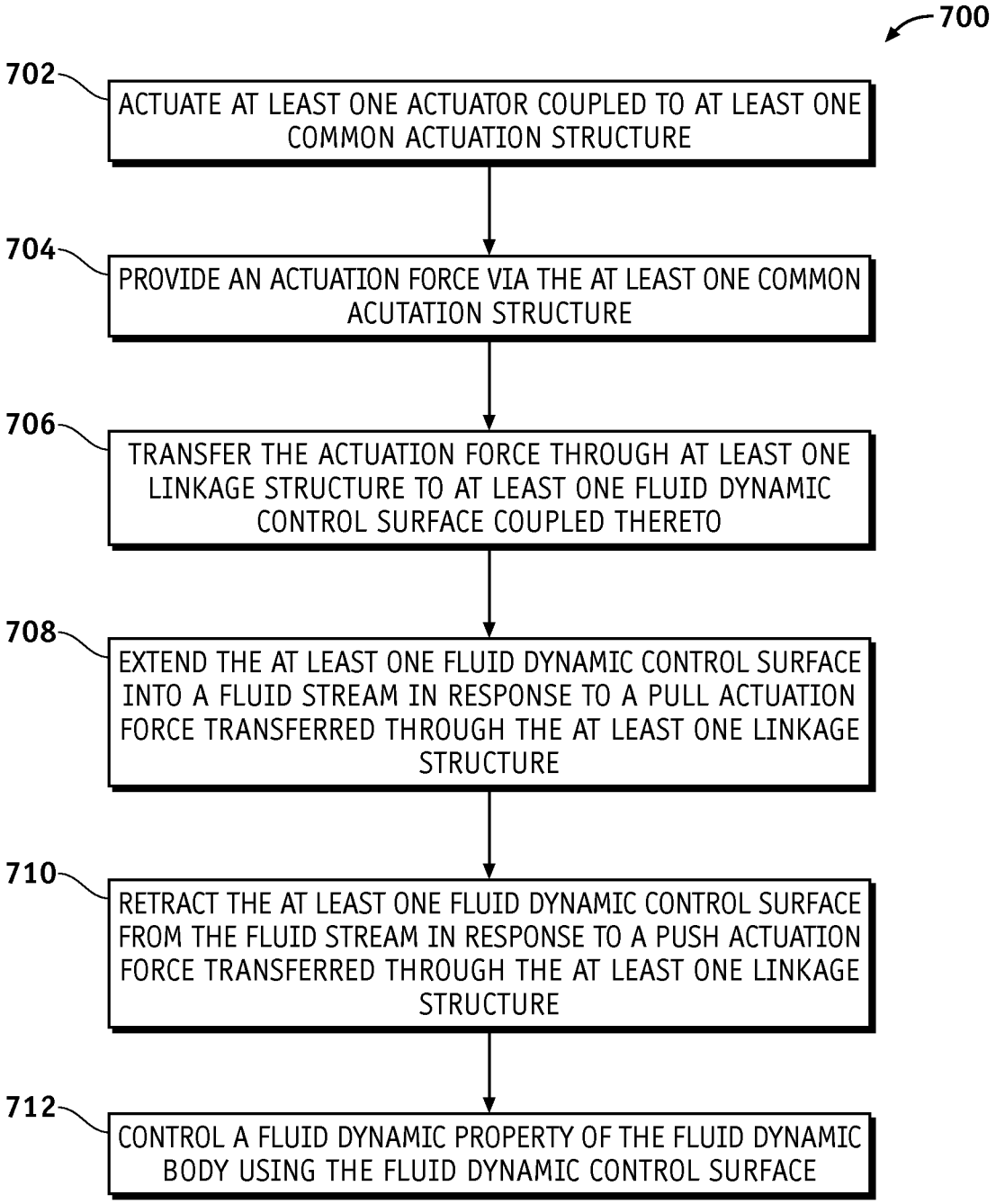
FIG. 7 is an illustration of an exemplary flowchart showing a process for aerodynamically controlling a projectile according to an embodiment of the disclosure.

FIG. 7 is an illustration of an exemplary flowchart showing a process 700 for aerodynamically controlling a projectile according to an embodiment of the disclosure. The various tasks performed in connection with the process 700 may be performed mechanically, by software, hardware, firmware, a computer-readable medium having computer executable instructions for performing the processes methods, or any combination thereof. For illustrative purposes, the following description of the process 700 may refer to elements mentioned above in connection with FIGS. 1-6. In practical embodiments, portions of the process 700 may be performed by the aerodynamic control surface 106, the linkage structure 204, the common actuation structure 108, the actuator 118, the controller 120, etc. Process 700 may have functions, material, and structures that are similar to the embodiments shown in FIGS. 1-6. Therefore, common features, functions, and elements may not be redundantly described here.

Process 700 may begin by actuating at least one actuator such as the actuator 118 coupled to at least one common actuation structure such as the common actuation structure 108 (task 702).

Process 700 may continue by providing an actuation force via the common actuation structure 108 (task 704). As mentioned above, the common actuation structure 108 may comprise, for example but without limitation, a ring, a disk, an annulus, a polygonal solid, and the like.

Process 700 may continue by transferring the actuation force through at least one linkage structure such as the linkage structure 204 to at least one fluid dynamic control surface such as the aerodynamic control surface 106 coupled thereto (task 706).

Process 700 may continue by extending the fluid dynamic control surface into a fluid stream such as the airstream 122 in response to a first actuation force such as the pull actuation force 208 transferred through at least one linkage structure 204 (task 708). The aerodynamic control surface 106 may be coupled to an aerodynamic body such as the aerodynamic body 104. The aerodynamic control surface 106 may be located on an aft end 116 of the aerodynamic body 104. As mentioned above, the aerodynamic body 104 may comprises, a projectile flight body, such as but without limitation, a bullet, a missile, an artillery shell, and the like.

Process 700 may then continue by retracting the aerodynamic control surface 106 from the airstream 122 in response to a second actuation force such as the push actuation force 206 transferred through at least one linkage structure 204 (task 710).

Process 700 may continue by controlling a fluid dynamic property such as an aerodynamic property of the aerodynamic body 104 using the aerodynamic control surface 106 (task 712). The fluid dynamic property may comprise, for example but without limitation, a direction, a rotation, a deceleration, a fluid dynamic drag, a precession, a lift, and the like.

Figure 8:
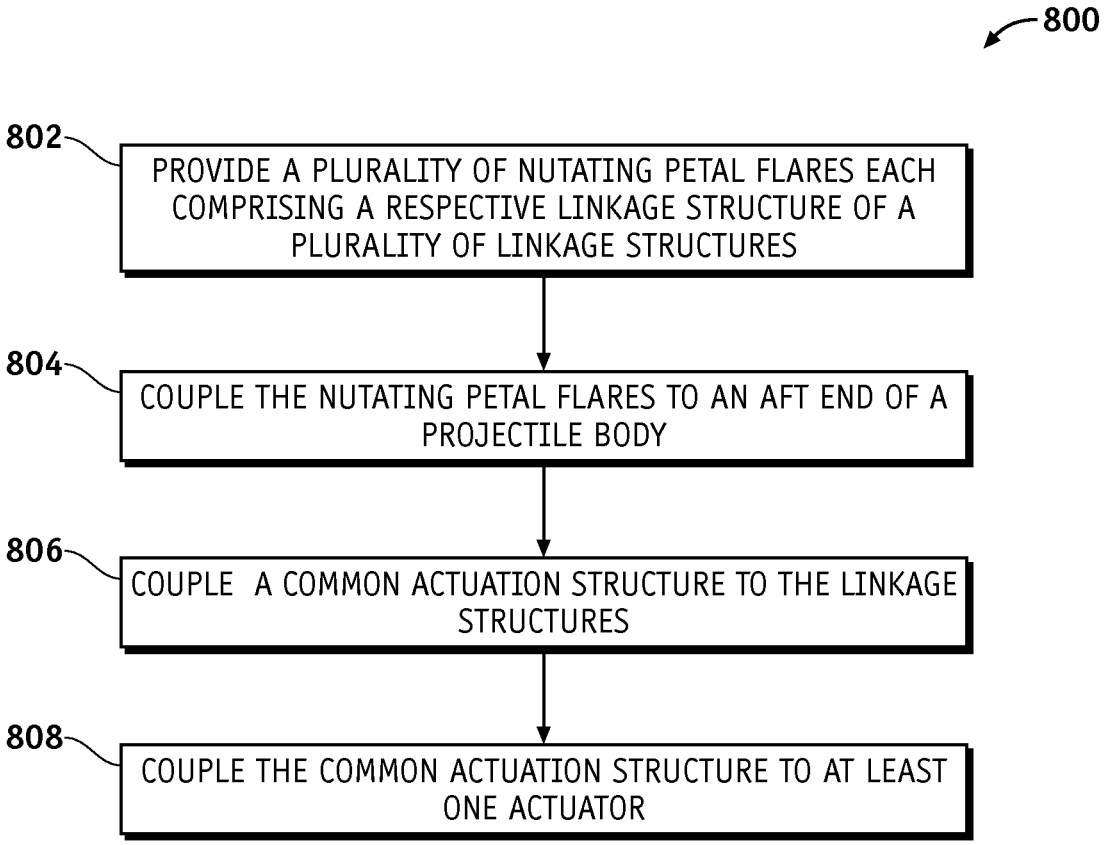
FIG. 8 is an illustration of an exemplary flowchart showing a process for providing a projectile flight body aerodynamic control system according to an embodiment of the disclosure.

FIG. 8 is an illustration of an exemplary flowchart showing a process 800 for providing a projectile flight body aerodynamic control system according to an embodiment of the disclosure. The various tasks performed in connection with the process 800 may be performed mechanically, by software, hardware, firmware, or any combination thereof. For illustrative purposes, the following description of the process 800 may refer to elements mentioned above in connection with FIGS. 1-6. In practical embodiments, portions of the process 800 may be performed by the aerodynamic control surface 106, the linkage structure 204, the common actuation structure 108, the actuator 118, the controller 120, etc. Process 800 may have functions, material, and structures that are similar to the embodiments shown in FIGS. 1-6. Therefore, common features, functions, and elements may not be redundantly described here.

Process 800 may begin by providing a plurality of nutating petal flares such as the nutating petal flares 106 each comprising a respective linkage structure of a plurality of linkage structures 204 (task 802).

Process 800 may continue by coupling the nutating petal flares 106 to an aft end of a projectile body such as the aft end 116 of a projectile flight body such as the aerodynamic body 104 (task 804).

Process 800 may continue by coupling a common actuation structure such as the common actuation structure 108 to linkage structures such as the linkage structures 204 (task 806).

Process 800 may continue by coupling the common actuation structure 108 to at least one actuator such as the actuator 118 (task 808).

In this way, various embodiments of the disclosure provide a low complexity, low weight method of controlling a projectile.

While at least one example embodiment has been presented in the foregoing detailed description, it should be appreciated that a vast number of variations exist. It should also be appreciated that the example embodiment or embodiments described herein are not intended to limit the scope, applicability, or configuration of the subject matter in any way. Rather, the foregoing detailed description will provide those skilled in the art with a convenient road map for implementing the described embodiment or embodiments. It should be understood that various changes can be made in the function and arrangement of elements without departing from the scope defined by the claims, which includes known equivalents and foreseeable equivalents at the time of filing this patent application.

The above description refers to elements or nodes or features being "connected" or "coupled" together. As used herein, unless expressly stated otherwise, "connected" means that one element/node/feature is directly joined to (or directly communicates with) another element/node/feature, and not necessarily mechanically. Likewise, unless expressly stated otherwise, "coupled" means that one element/node/feature is directly or indirectly joined to (or directly or indirectly communicates with) another element/node/feature, and not necessarily mechanically. Thus, although FIGS. 1-6 depict example arrangements of elements, additional intervening elements, devices, features, or components may be present in an embodiment of the disclosure.

Terms and phrases used in this document, and variations thereof, unless otherwise expressly stated, should be construed as open ended as opposed to limiting. As examples of the foregoing: the term "including" should be read as mean "including, without limitation" or the like; the term "example" is used to provide exemplary instances of the item in discussion, not an exhaustive or limiting list thereof; and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that may be available or known now or at any time in the future.

Likewise, a group of items linked with the conjunction "and" should not be read as requiring that each and every one of those items be present in the grouping, but rather should be read as "and/or" unless expressly stated otherwise. Similarly, a group of items linked with the conjunction "or" should not be read as requiring mutual exclusivity among that group, but rather should also be read as "and/or" unless expressly stated otherwise. Furthermore, although items, elements or components of the disclosure may be described or claimed in the singular, the plural is contemplated to be within the scope thereof unless limitation to the singular is explicitly stated.

The presence of broadening words and phrases such as "one or more," "at least," "but not limited to" or other like phrases in some instances shall not be read to mean that the narrower case is intended or required in instances where such broadening phrases may be absent. The term "about" when referring to a numerical value or range is intended to encompass values resulting from experimental error that can occur when taking measurements.

As used herein, unless expressly stated otherwise, "operable" means able to be used, fit or ready for use or service, usable for a specific purpose, and capable of performing a recited or desired function described herein. In relation to systems and devices, the term "operable" means the system and/or the device is fully functional and calibrated, comprises elements for, and meets applicable operability requirements to perform a recited function when activated.

The invention claimed is:

1. A projectile body fluid dynamic control system, comprising:

at least one fluid dynamic control surface coupled to a fluid dynamic body and operable to extend into a fluid stream around the fluid dynamic body;

at least one linkage structure coupled to the at least one fluid dynamic control surface and operable to extend the at least one fluid dynamic control surface into the fluid stream; and an actuation mechanism comprising:

a one-piece common actuation structure comprising an outer surface and operably connected to the fluid dynamic control surface, the one-piece common actuation structure directly coupled to the at least one linkage structure via the outer surface and operable to directly slide on the at least one linkage structure via the outer surface to transfer an actuation force through the at least one linkage structure such that the at least one fluid dynamic control surface is extended into the fluid stream, wherein the actuation force is capable of displacing the one-piece common actuation structure; and at least one actuator coupled to the one-piece common actuation structure by at least one rod extending directly from the at least one actuator and passing from beneath the outer surface and through and encircled by the one-piece common actuation structure and operable to provide the actuation force.

2. The system of claim 1, wherein:

the at least one actuator is further operable to provide a second actuation force; and the one-piece common actuation structure is further operable to transfer the second actuation force through the at least one linkage structure such that the at least one fluid dynamic control surface is retracted from the fluid stream.

3. The system of claim 1, wherein the at least one fluid dynamic control surface is further operable to control a fluid dynamic property of the fluid dynamic body.

4. The system of claim 3, wherein the fluid dynamic property comprises at least one member selected from the group consisting of: a direction, a rotation, a deceleration, a fluid dynamic drag, a precession, and a lift.

5. The system of claim 1, wherein the at least one fluid dynamic control surface is located on an aft end of the fluid dynamic body.

6. The system of claim 1, wherein the at least one fluid dynamic control surface comprises at least one nutating petal flare.

7. The system of claim 1, further comprising a controller operable to control the at least one actuator.

8. The system of claim 7, wherein the controller is further configured to change a direction of a rotation axis of the at least one fluid dynamic control surface in which an Euler angle is constant.

9. The system of claim 7, wherein the controller is further configured to control variable body static margin.

10. The system of claim 7, wherein the controller is further configured to control a lift of the fluid dynamic body.

11. The system of claim 1, wherein the fluid dynamic body comprises a projectile flight body.

12. The system of claim 11, wherein the projectile flight body comprises one at least one member selected from the group consisting of: a bullet shape, a missile shape, or an artillery shell shape.

13. The system of claim 1, wherein the one-piece common actuation structure comprises at least one member selected from the group consisting of: a ring, a disk, an annulus, and a polygonal solid.

14. The system of claim 1, wherein the at least one linkage structure each comprise a ramp comprising at least two sloped flat surfaces comprising at least one straight-line transition between slopes of the flat surfaces.

15. The system of claim 1, wherein the outer surface is continuous.

16. A method of providing a projectile body fluid dynamic control system, the method comprising:

providing a plurality of nutating petal flares each comprising a respective linkage structure of a plurality of linkage structures and coupled to a fluid dynamic body and operable to extend into a fluid stream around the fluid dynamic body;

coupling the nutating petal flares to an aft end of the fluid dynamic body;

coupling a one-piece common actuation structure comprising an outer surface directly to the linkage structures via the outer surface;

coupling the one-piece common actuation structure to at least one actuator by at least one rod extending directly from the at least one actuator and passing from beneath the outer surface and through and encircled by the one-piece common actuation structure; and configuring the one-piece common actuation structure to directly slide on the linkage structures via the outer surface to transfer an actuation force through the at least one linkage structure such that at least one of the nutating petal flares is extended into the fluid stream, wherein the actuation force is capable of displacing the one-piece common actuation structure.

17. The method of claim 16, further comprising configuring a controller to control the at least one actuator to change a direction of a rotation axis of the nutating petal flares in which an Euler angle is constant.

18. The method of claim 16, further comprising configuring a controller to control variable body static margin.

19. The method of claim 16, further comprising configuring a controller to control a lift of the fluid dynamic body.

20. The method of claim 16, wherein the linkage structures each comprise a ramp comprising at least two sloped flat surfaces comprising at least one straight-line transition between slopes of the flat surfaces.

* * * * *